US006745713B2

(12) United States Patent
Starbuck

(10) Patent No.: US 6,745,713 B2
(45) Date of Patent: Jun. 8, 2004

(54) CONTROL DEVICE FOR KITE

(75) Inventor: David Starbuck, Kula, HI (US)

(73) Assignee: Neil Pryde Limited, Tuen Mun (HK)

( * ) Notice: Subject to any disclaimer, the term of this patent is extended or adjusted under 35 U.S.C. 154(b) by 0 days.

(21) Appl. No.: 10/304,298

(22) Filed: Nov. 26, 2002

(65) Prior Publication Data

US 2003/0116071 A1 Jun. 26, 2003

Related U.S. Application Data

(63) Continuation-in-part of application No. 09/804,282, filed on Mar. 12, 2001, now Pat. No. 6,513,759.

(51) Int. Cl.[7] ..... A63H 27/08; B64C 31/06

(52) U.S. Cl. ..... 114/39.16; 114/39.18; 244/155 A

(58) Field of Search ..... 114/39.13, 39.16, 114/39.18, 102.1, 102.11, 102.16; 280/810; 244/155 R, 155 A, 153 R

(56) References Cited

U.S. PATENT DOCUMENTS 4,127,247 A 11/1978 Strasilla
5,366,182 A 11/1994 Roeseler et al.
6,273,369 B1 8/2001 Nishimura et al.
6,513,759 B2 * 2/2003 Starbuck ..... 244/155 A
6,581,879 B2 * 6/2003 Bellacera ..... 244/155 A

* cited by examiner

*Primary Examiner*—Sherman Basinger
(74) *Attorney, Agent, or Firm*—Jackson Walker, LLP

(57) ABSTRACT

A control device for a kite comprises an elongate rigid control bar extending either side of a central region to provide separated hand-grippable regions for a kite user and anchor points for first and second control lines of a kite. A third control line for the kite is attached to a harness loop at one end and extends from the harness loop towards the kite. A stopper is rigidly fixed to the third control line adjacent the harness loop. The stopper is wedge shaped in a predetermined plane. A body is attached to the central region of the control bar. The body has a cavity for releasably receiving the stopper and an opening in a wall of the cavity. The cavity is wedge shape towards the opening for rotating the stopper to the predetermined plane when it engages against the inner walls of the cavity.

5 Claims, 3 Drawing Sheets

CONTROL DEVICE FOR KITE

This application is a continuation-in-part of U.S. Ser. No. 09/804,282, filed Mar. 12, 2001, now U.S. Pat. No. 6,513, 759 issued Feb. 4. 2003.

BACKGROUND OF THE INVENTION

1. Field of the Invention

The invention relates to kites, and in particular to control devices for kites.

2. Description of Prior Art

In kite-surfing and similar traction-kite sports a kite is used and controlled by a user or operator to propel and sometimes lift the user or operator during use. The kite operator can control the power generated by the kite by manipulating control lines to alter the effective angle of attack does not effect curvature of the kite canopy in a manner well understood.

In the most common basic kites the user or operator uses a control bar with two lines, one at each end of the bar. He controls the direction of the kite by pulling on the left of the bar to go left and on the right to go right.

Typically, the kite is provided with a control bar with lines extending to the kite canopy, and it has already been proposed to have a control bar where three control lines are used. Sidelines are attached to respective bars on (side) tips of the kite and a centre line is attached to both forward sides on a leading edge of the kite. If the control bar is pulled toward the body of the operator or moved away from the body of the operator (at times the kite is perpendicular to the water), so that the side lines are shortened or lengthened relative to the centre line, the angle at which the canopy passes through the air (referred to as "angle of attack" in aviation terms) is reduced or increased which reduces or increases the lifting force. This in turn increases or decreases the effective power generated by the kite.

It is already known to arrange for the control bar to be attachable by a harness loop that can be placed onto a suitable hook on the user's or operator's harness.

In a present arrangement, the control bar is attached to the harness loop by a releasable friction lock applied to the central control line. The control bar has a central aperture to receive the central line and when the control bar aperture is 'in line' with the central line, the line is generally free to slide through the aperture. The lines are attached to the control bar so that with hands off the central control line is normally locked. If the control bar is rotated by say 90° about it's longitudinal axis, the central line is frictionally unlocked and can slide through the aperture. Such a frictional locking arrangement is not wholly reliable in its locking function of the central line and normal usage tends to cause abrasion of the central line. Further, the harness loop is free to adopt random orientations with respect to the control bar and so can be difficult engage on a harness hook during use.

SUMMARY OF THE INVENTION

It is an object of the invention to overcome or at least reduce some or all these problems.

According to a first aspect of the invention there is provided a control device for a kite comprising:

an elongate rigid control bar extending either side of a central region to provide separated hand-grippable regions for a kite user and anchor points for first and second control lines of a kite, a third control line for the kite attached to a harness loop at one end and extending from the harness loop towards the kite, a body attached to the central region of the control bar and having a cavity with an opening through which the third control line passes, a stopper rigidly fixed to the third control line and releasably receivable in the cavity for restricting relative movement between the control bar and third control line.

Preferably, the stopper is wedge shaped in a predetermined axial plane, and the cavity is wedge shape towards the opening for axially rotating the stopper to the predetermined plane to facilitate easy fitting of the harness loop to a harness hook.

According to a second aspect of the invention there is provided a control device for a kite comprising:

an elongate rigid control bar extending either side of a central region to provide separated hand-grippable regions for a kite user and anchor points for first and second control lines of a kite, a third control line for the kite attached to a harness loop at one end and extending from the harness loop towards the kite, a body attached to the central region of the control bar and having a cavity with an opening through which the third control line passes, a stopper rigidly fixed to the third control line and releasably receivable in the cavity, wherein an inner wall of the cavity is wedge shape adjacent the opening for rotating the stopper axially when it engages against the inner wall and maintaining the harness loop in a specific axial orientation.

Preferably, the cavity is substantially symmetrical remote from the opening for permitting free axial rotation of the stopper.

BRIEF DESCRIPTION OF THE DRAWINGS

A control device for a kite according to the invention will now be described by way of example only, and with reference to the accompanying drawings in which.

DESCRIPTION OF THE PREFERRED EMBODIMENTS

Figure 1:
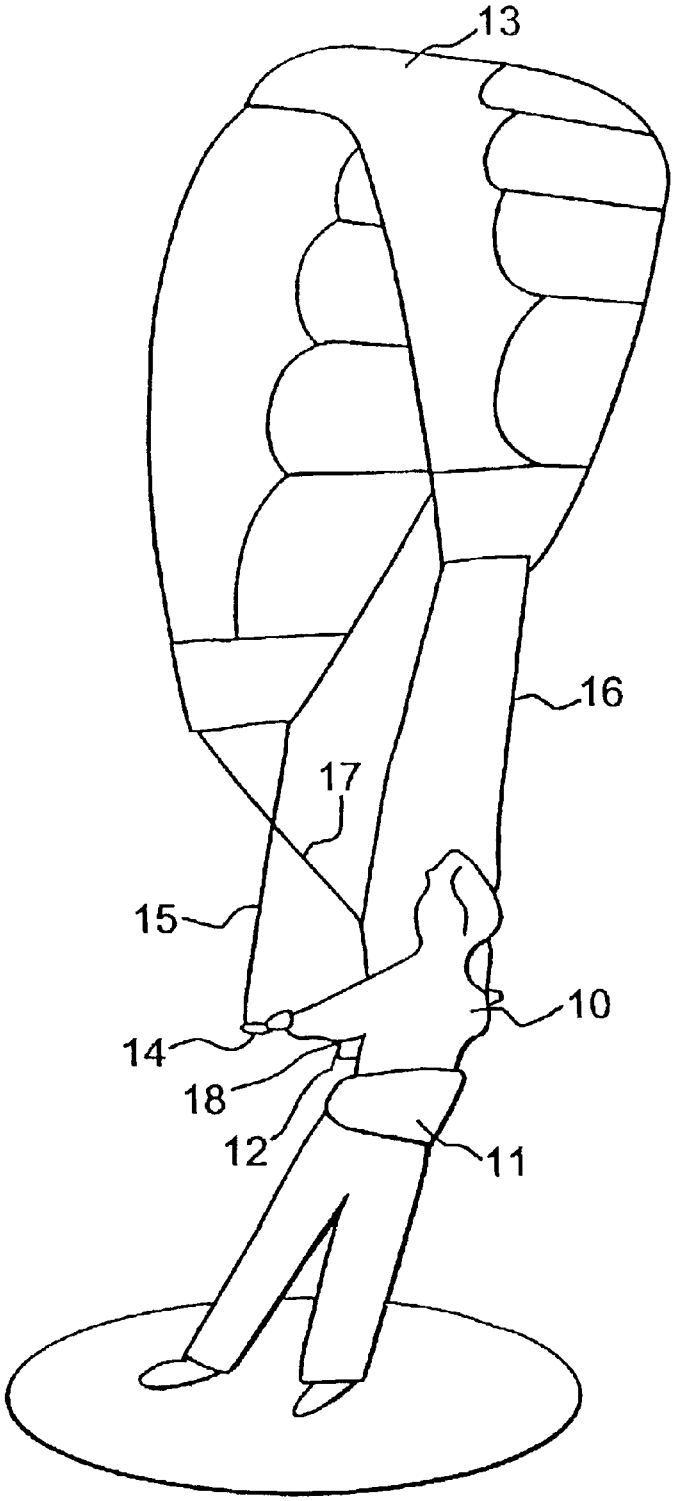
FIG. 1 illustrates a user or operator and a kite.

Referring to the drawings, in FIG. 1 a user or operator 10 has harness 11 provided with a conventional hook 12. A kite 13 is connected to a control bar 14 by two side control lines 15 and 16 and a central control line 17, in a manner already proposed for sports kites. A harness loop 18 is attached to the hook 12.

Figure 2:
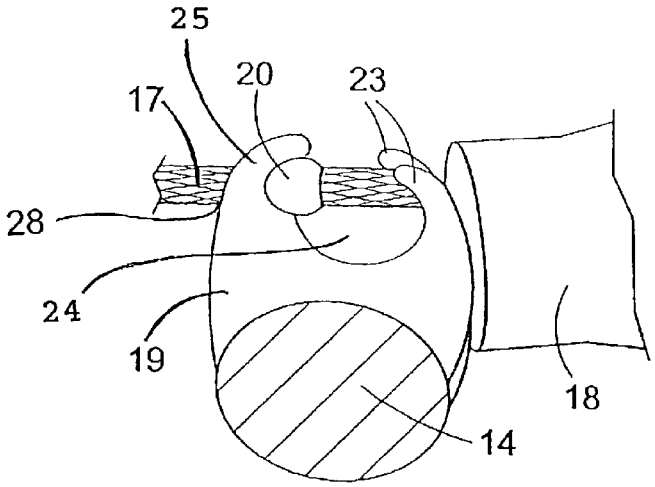
FIG. 2 shows an isometric side view of a locking arrangement for locking a central line to a control bar.

FIG. 2 shows a novel locking arrangement for releasably locking the central control line 17 to the control bar 14. The locking arrangement consists of an open top body 19, with a cavity 24, that fits rigidly at a central region of the control bar 14 and a non-uniform metal ball 20 that is rigidly fixed to the central control line 17 proximate hook 12. The control line 17 passes through an aperture 28 in the forward wall 25 of the open top body 19. The rearward wall of the cavity has a fork with two guide hooks 23 either side thereof. The central control line 17 can freely move in and out of the fork and slidably move longitudinally through the fork.

The ball 20 acts as a stopper and can be releasably fitted into the cavity 24 of lock body 19 through the open top as required. When the ball 20 is in the cavity 24, as shown in FIG. 2, the control bar 14 and central line 17 are restrained relative to each other.

Figure 3:
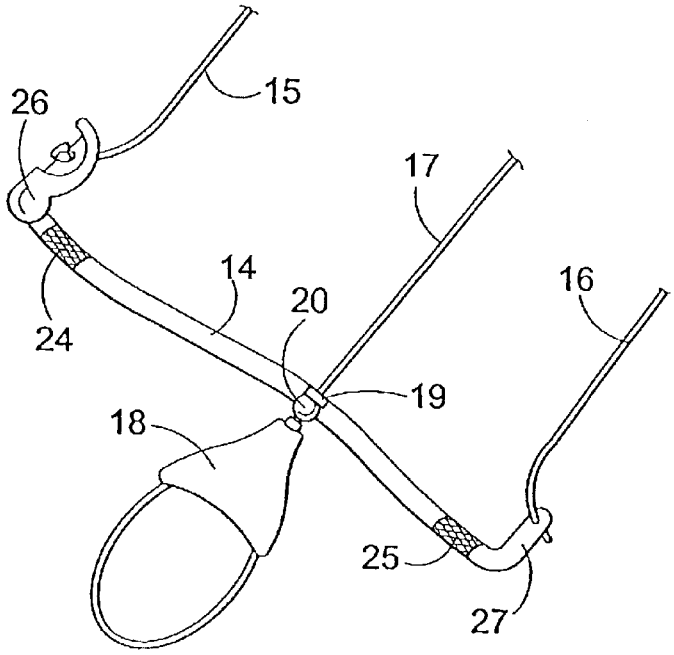
FIG. 3 is an isometric view of the control bar with the central line locked with respect to the control bar.
Figure 4:
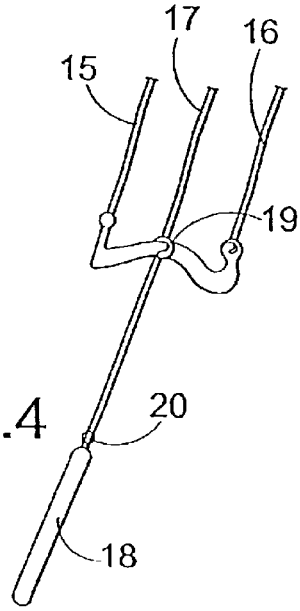
FIG. 4 is isometric view of with the central line unlocked with the control bar.

In FIGS. 3 and 4, the rigid control bar 14 extends either side of the central region where the lock body 19 is fixed to provide separated hand-grippable regions 24 and 25 adjacent anchor point 26 and 27 provided for the side lines 15 and 16. When the ball 20 is in the lock body 19, the kite will be configured to generate maximum power (FIG. 3). When the ball is released from the body (FIG. 4), so that the control bar 14 can be moved towards the kite, the kite can be depowered.

In order to release the ball 20 the user or operator must rotate the control bar about its longitudinal axis (anti-clockwise in FIG. 3) through about 90-degrees to allow the ball 20 to "tip out" of the body 19. With the ball 20 released from the cavity 23 the control bar 14 is free to move back and forth along the central control line 17 so that the user or operator can control the power of the kite 13.

Figure 5:
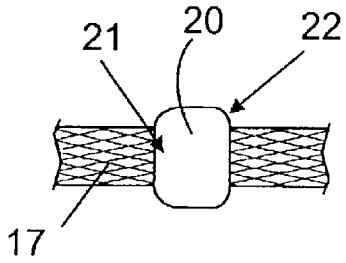
FIG. 5 is a view in a first plane of a stopper for the locking arrangement.
Figure 6:
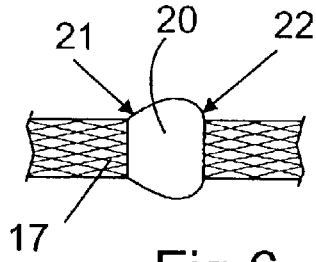
FIG. 6 is a view in a second plane of the stopper for the locking arrangement.

Referring to FIGS. 5 and 6, the ball 20 has a forward end 21 with a profile that is wedge shaped in a first plane and symmetrical with rear edge 22 in a second plane 90-degrees axially to the first plane. The cavity 24 has a wedge shaped profile 29 towards the aperture 28 in forward wall 25. The wedge shaped profile 29 in the cavity matches the wedge shape of the ball 20.

Figure 7:
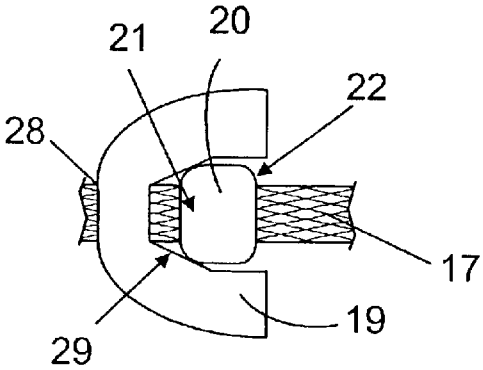
FIG. 7 illustrates the stopper engaging the lock body in a first orientation.
Figure 8:
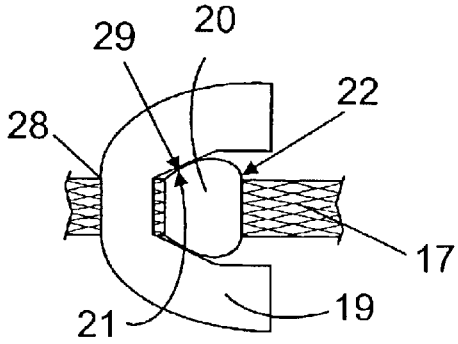
FIG. 8 illustrates the stopper engaging the lock body in a second orientation.

Referring to FIGS. 7 and 8, when the ball is located in the cavity 24 and moved towards the forward wall 25 the ball and central control line 17 are rotated to cause the ball's wedge shape forward end 21 to fit snugly in the wedge shaped profile 29 of the cavity 24. This maintains the central control line 17 in a specific axial orientation to the body 19 and hence to the control bar 14. As a result, the harness loop 18 is held in an orientation that in practice is in a plane parallel to the control bar 14 to facilitate attaching the harness loop 18 to the hook 12 when required. No such provision is made in prior art arrangement and as a result the central line 17 and hence the harness loop 18 are otherwise free to rotate, the harness loop 18 can adopt orientations making it impossible or very difficult to engage the hook 12during normal use.

A rear end 22 of the ball 20 is spherical and is arranged to mate with a spherical inner surface of the body formed between two guide hooks 23. If the ball 20 is held against the surface between the hooks 23 the centre line 17 and the harness hoop is free to rotate relative to the control bar 14. This allows the user or operator to 'spin' the control bar 14 as may be required after any maneuvers that cause the side lines to twist together.

The user or operator is provided with three distinct configurations.

1. The ball 20 is in the lock body 19 and the harness loop 18 is not hooked to the harness hook 12. The user or operator is pulled along by the kite 13 and steers the kite with his hands on the control bar 14. The wedged forward end 21 of the ball 20 is pressed against the forward wall 25 of cavity 23 in body 19. This rotates the ball 20 and thus control line 17 and the harness loop 18 parallel to the longitudinal axis of the control bar 14 and makes it easy for the user or operator to put the harness loop 18 on to the hook 12.
2. The ball 20 is in the lock body 19 and the harness loop 18 is on the hook 12. The user or operator steers with his hands on the control bar and is pulled by the kite through the hook 12. The rear end 22 of the ball is urged against the rear surface of the cavity 23 between the guide hooks 23 in lock body 19. The user or operator can take his hands off the control bar 14 and spin the control bar 14 about the central line 17.
3. The ball 20 is out of the lock body 19 and the control bar 14 is away from the body of the user or operator. The operator adjusts power by how close or far he holds the control bar from his body. The user or operator is being pulled by the kite via the hook 12 and by his hands.

The described control device enables the user or operator to readily change between the three configurations when required. The locking arrangement is reliable and does not cause unusual abrasions to the central control line in use.

It will be appreciated that other specific forms of locking arrangement can be used in which the shape of the ball 20 or a stopper may take other forms. Any kind of 'stopper' fixed to the central line that can be slotted into an open topped lock body fitted to a central region of the control bar can be used. The stopper is also arranged to be 'tipped' out of the lock body by rotating the control bar to release the central line when required. It is normally preferable however, as explained in the description, that the stopper and lock body are configured or co-operatively shaped to allow relative rotation of the control bar and the central line to untwist the side lines on the one hand. On the other hand the locking arrangement should maintain relative axial orientation of the control bar and the harness loop to facilitate interchange between the three distinct configurations mentioned above.

It will be appreciated that the control device may be used for kites used in sporting activities other than surfing.

Where in the foregoing description reference has been made to integers or elements having known equivalents then such are included as if individually set forth herein.

Embodiments of the invention have been described, however it is understood that variations, improvements or modifications can take place without departure from the spirit of the invention or scope of the appended claims.

What is claimed is:

1. A control device for a kite comprising:

an elongate rigid control bar extending either side of a central region to provide separated hand-grippable regions for a kite user and anchor points for first and second control lines of a kite, a third control line for the kite attached to a harness loop at one end and extending from the harness loop towards the kite, a body attached to the central region of the control bar and having a cavity with an opening through which the third control line passes, a stopper rigidly fixed to the third control line and releasably receivable in the cavity for restricting relative movement between the control bar and third control line.

2. The control device of claim 1 wherein the stopper is wedge shaped in a predetermined axial plane, and the cavity is wedge shape towards the opening for axially rotating the stopper to the predetermined plane to facilitate easy fitting of the harness loop to a harness hook.

3. A control device for a kite comprising:

an elongate rigid control bar extending either side of a central region to provide separated hand-grippable regions for a kite user and anchor points for first and second control lines of a kite, a third control line for the kite attached to a harness loop at one end and extending from the harness loop towards the kite, a body attached to the central region of the control bar and having a cavity with an opening through which the third control line passes, a stopper rigidly fixed to the third control line and releasably receivable in the cavity, wherein an inner wall of the cavity is wedge shape adjacent the opening for rotating the stopper axially when it engages against the inner wall adjacent the opening and maintaining the harness loop in a specific axial orientation.

4. The control device of claim 3 wherein the cavity is substantially symmetrical remote from the opening for permitting free axial rotation of the stopper.

5. A control device for a kite comprising:

an elongate rigid control bar extending either side of a central region to provide separated hand-grippable regions for a kite user and anchor points for first and second control lines of a kite, a third control line in for the kite attached to a harness loop at one end and extending from the harness loop towards the kite, a body attached to the central region of the control bar having a cavity with an opening through which the third control line passes, a stopper rigidly fixed to the third control line and releasably receivable in the cavity for restricting relative movement between the control bar and third control line, wherein the stopper is wedge shaped in a predetermined axial plane, and the cavity is wedge shape towards the opening for axially rotating the stopper to the predetermined plane to facilitate easy fitting of the harness loop to a harness hook.

* * * * *